US006901866B2

(12) United States Patent
Mutascio et al.

(10) Patent No.: US 6,901,866 B2
(45) Date of Patent: Jun. 7, 2005

(54) COMBUSTIBLE CASED TELESCOPED AMMUNITION ASSEMBLY

(75) Inventors: Enrico R. Mutascio, Palm Springs, CA (US); Paul D. Heidenreich, San Diego, CA (US); James M. Krushat, Palm Springs, CA (US); Bogden I. Vladescu, La Quinta, CA (US)

(73) Assignee: Armtec Defense Products Company, Coachella, CA (US)

( * ) Notice: Subject to any disclaimer, the term of this patent is extended or adjusted under 35 U.S.C. 154(b) by 0 days.

(21) Appl. No.: 10/305,932

(22) Filed: Nov. 27, 2002

(65) Prior Publication Data

US 2003/0121444 A1 Jul. 3, 2003

Related U.S. Application Data

(60) Provisional application No. 60/333,577, filed on Nov. 27, 2001.

(51) Int. Cl.[7] ..... F42B 5/18

(52) U.S. Cl. ..... 102/431; 102/433

(58) Field of Search ..... 102/431, 433, 102/341, 342, 343, 344, 339, 340, 369, 370, 403

(56) References Cited

U.S. PATENT DOCUMENTS

| | | | | |
|---|---|---|---|---|
| 2,072,671 A | | 3/1937 | Foulke | |
| 2,866,412 A | | 12/1958 | Meyer et al. | |
| 2,996,988 A | | 8/1961 | Kunz | |
| 3,705,549 A | | 12/1972 | Quinlan et al. | |
| 3,901,153 A | * | 8/1975 | Brabets et al. | 102/433 |
| 4,015,527 A | * | 4/1977 | Evans | 102/433 |
| 4,197,801 A | | 4/1980 | LaFever et al. | |
| 4,220,089 A | | 9/1980 | Smith | |
| 4,335,657 A | | 6/1982 | Bains | |
| 4,444,115 A | | 4/1984 | Romer et al. | |
| 4,535,697 A | | 8/1985 | Moser et al. | |
| 4,593,622 A | | 6/1986 | Fibranz | |
| 4,604,954 A | | 8/1986 | Clarke et al. | |
| 4,763,577 A | | 8/1988 | Romer et al. | |
| 4,802,415 A | | 2/1989 | Clarke et al. | |
| 4,815,390 A | * | 3/1989 | Garcia | 102/489 |
| 4,907,510 A | | 3/1990 | Martwick et al. | |
| 5,029,530 A | | 7/1991 | Martwick et al. | |
| 5,042,388 A | | 8/1991 | Warren et al. | |
| 5,155,295 A | | 10/1992 | Campoli | |

(Continued)

FOREIGN PATENT DOCUMENTS

| | | |
|---|---|---|
| EP | 0 483 787 | 5/1992 |
| EP | 0 307 307 B1 | 7/1992 |
| GB | 2 044 416 | 10/1980 |
| WO | WO 94/20813 A1 | 9/1994 |
| WO | WO 94/20814 A1 | 9/1994 |
| WO | WO 99/24778 | 5/1999 |

OTHER PUBLICATIONS

International Search Report dated Mar. 28, 2003 for PCT Application PCT/US/02/33906.

*Primary Examiner*—Teri Pham Luu
*Assistant Examiner*—Susan C. Alimenti
(74) *Attorney, Agent, or Firm*—Perkins Coie LLP

(57) ABSTRACT

An apparatus and method relating to a cased telescoped ammunition assembly configured to be fired from a firing device. Under one aspect of the invention, a cased telescoped ammunition assembly includes a combustible case body and noncombustible end caps connected to opposing ends of the case body. The case body is configured to be substantially consumed in combustion when the ammunition assembly is fired. An internal support structure is positioned in the interior portion of the case body and connected to the end caps. The internal support structure and the end caps define a load-bearing unit that provides a load path substantially independent of the case body. The load-bearing unit is configured to react external loads, such that the combustible case body is substantially isolated from and does not react the external loads.

35 Claims, 3 Drawing Sheets

U.S. PATENT DOCUMENTS 5,160,804 A 11/1992 Wähner et al.
5,233,928 A 8/1993 Ducros et al.
5,265,540 A 11/1993 Ducros et al.
5,333,551 A 8/1994 Heitmann et al.
5,388,522 A * 2/1995 Martwick et al. ..... 102/434
5,415,104 A 5/1995 Bispling et al.
5,433,148 A * 7/1995 Barratault et al. ..... 102/434
5,467,716 A 11/1995 Boual
5,557,059 A 9/1996 Warren et al.
5,841,062 A 11/1998 Manole et al.
6,119,600 A 9/2000 Burri
6,158,348 A 12/2000 Campoli
6,457,603 B1 10/2002 Freist et al.

* cited by examiner

COMBUSTIBLE CASED TELESCOPED AMMUNITION ASSEMBLY

CROSS-REFERENCE TO RELATED APPLICATION(S)

This non-provisional patent application claims priority to provisional U.S. patent application Ser. No. 60/333,577, entitled COMBUSTIBLE CASED TELESCOPED AMMUNITION ROUND ASSEMBLY, filed Nov. 27, 2001, hereby incorporated in its entirety by reference thereto.

TECHNICAL FIELD

The present invention is related to ammunition rounds, and more particularly to cased telescoped ammunition rounds and ammunition firing systems.

BACKGROUND

Conventional cased telescoped ammunition is well known, particularly in connection with larger caliber firing systems. Representative conventional cased telescoped ammunition is disclosed in U.S. Pat. No. 4,907,510 (Martwick et al.), U.S. Pat. No. 4,604,954 (Clarke et al.), U.S. Pat. No. 4,335,657 (Bains), U.S. Pat. No. 4,220,089 (Smith); U.S. Pat. No. 4,197,801 (LaFever et al.), U.S. Pat. No. 2,996,988 (Kunz), and U.S. Pat. No. 2,866,412 (Meyer et al.). The cased telescoped ammunition disclosed in these references have drawbacks, and there is a need for a cased telescoped ammunition round assembly that provides improved performance and reliability.

SUMMARY

The present invention provides an apparatus and method relating to a cased telescoped ammunition assembly that overcomes drawbacks experienced in the prior art. Under one aspect of the invention, a cased telescoped ammunition assembly is configured to be fired from a firing device. The assembly includes a combustible case body and noncombustible end caps connected to opposing ends of the case body. The case body is configured to be substantially consumed in combustion when the ammunition assembly is fired. An internal support structure is positioned in the interior portion of the case body and connected to the end caps. The internal support structure and the end caps define a load-bearing unit that provides a load path substantially independent of the case body. The load-bearing unit is configured to react external loads, such that the combustible case body is substantially isolated from and does not react the external loads.

Under another aspect of the invention, a method is provided for firing a cased telescoped ammunition assembly. The method includes loading the cased telescoped ammunition assembly into a breech of the firing device, whereby the ammunition round may be exposed to external loads. The external loads are reacted by the load-bearing unit along the load path, such that the case body is substantially isolated from the external loads. Propellant in the ammunition assembly is ignited, whereby the propellant and the case body are consumed in combustion, and the projectile is propelled into the barrel of the firing device. The end caps and the internal support are noncombustible and define a single spent unit after the propellant and the case body are consumed, and the spent unit is ejected from the breech after the projectile has been propelled into the barrel.

DETAILED DESCRIPTION

A combustible cased telescoped ammunition assembly and a corresponding method for firing the ammunition assembly in accordance with one or more embodiments of the present invention are described in detail herein. The following description sets forth numerous specific details, such as specific materials usable for the assembly and specific structures for use in manufacturing the assembly, to provide a thorough and enabling description for embodiments of the invention. One skilled in the relevant art, however, will recognize that the invention can be practiced without one or more of the specific details. In other instances, well-known structures or operations are not shown, or are not described in detail to avoid obscuring aspects of the invention.

Figure 1:
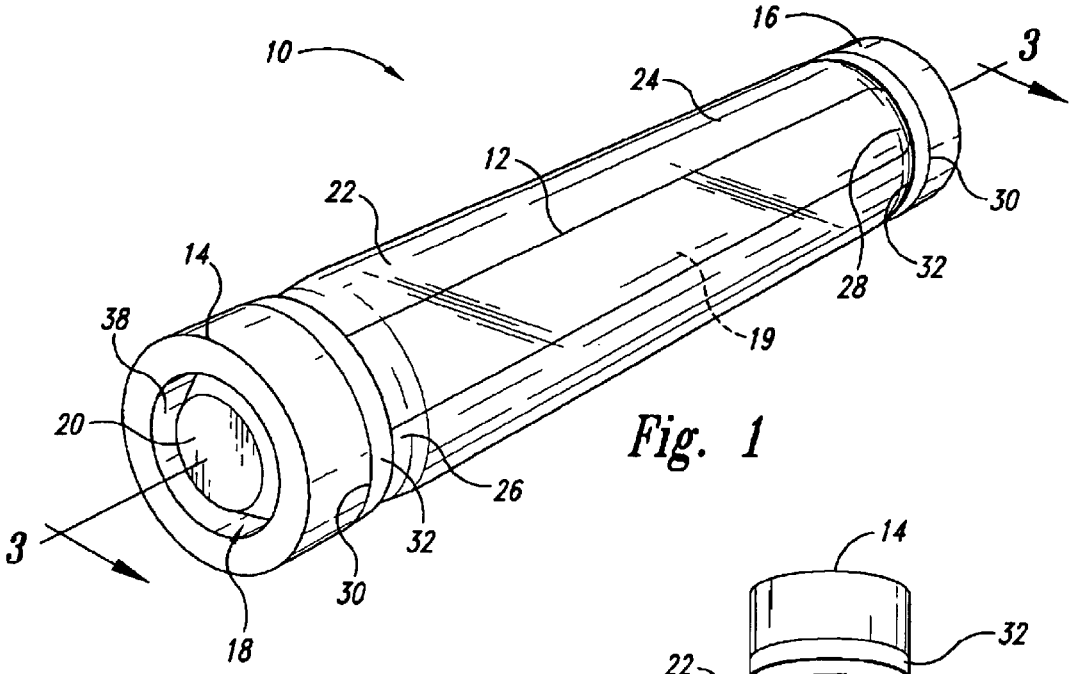
FIG. 1 is an isometric view of a combustible cased telescoped ammunition assembly in accordance with one embodiment of the invention.
Figure 2:
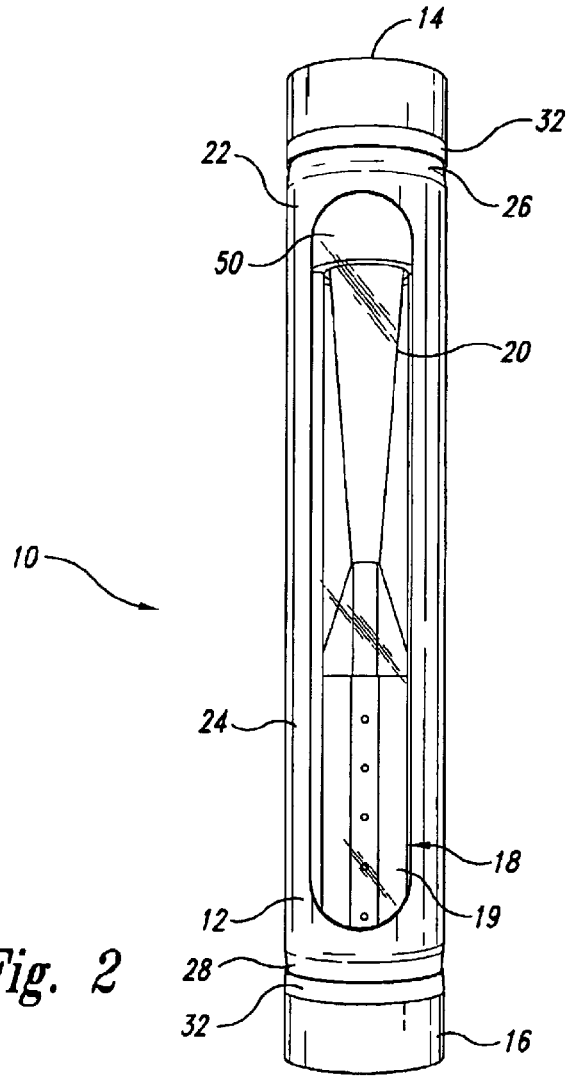
FIG. 2 is a partially cut-away side elevation view of the ammunition assembly of FIG. 1.

FIG. 1 is an isometric view of a combustible cased telescoped ammunition assembly 10 in accordance with one embodiment of the invention. FIGS. 2 is a partially cut-away side elevation view of the ammunition assembly 10. FIGS. 1 and 2 show for illustrative purposes the ammunition assembly 10 having a combustible case body 12 supported by top and bottom end caps 14 and 16. The top and bottom end caps 14 and 16 are noncombustible members rigidly connected to a noncombustible internal support structure 18 (FIG. 2) located within the interior area 19 of the case body 12. A projectile 20 is contained within the case body 12 and the top end cap 14. The projectile 20 is configured to be fired out of a conventional firing device (not shown). The use of the combustible case body 12 with the noncombustible end caps 14 and 16 and the noncombustible internal support structure 18 is configured to yield a robust assembly in its pre-fired state. The end caps 14 and 16 and the support structure 18 form a unitary, noncombustible, load-bearing unit that, in the post-fired state, allows for the reliable ejection of the spent item from the firing device.

In the illustrated embodiment, the combustible case body 12 is a substantially cylindrical body having an outer diameter slightly smaller than the inner diameter of the breech of the firing device. The case body 12 is fabricated from a combustible composite material, such as a resinated molded fiber composite with an energetic component in the form of nitrocellulose fibers. Alternate embodiments can use other combustible composite materials. The combustible case body 12 is comprised of a forward part 22 and an aft part 24 that mate to form the completed combustible case body 12. The two-piece case body 12 allows for easier manufacture of the ammunition assembly 10. Alternate embodiments, however, can use a single-piece case body 12.

Figure 3:
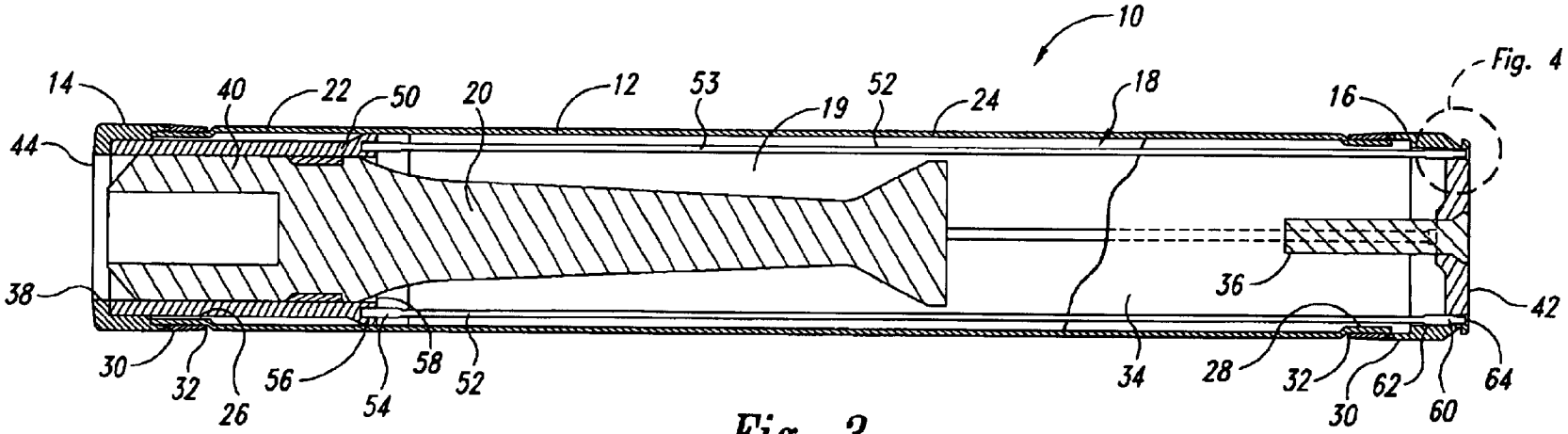
FIG. 3 is an enlarged cross-sectional view taken substantially along line 3—3 of FIG. 1 showing the internal components of the ammunition assembly.

As best seen in FIG. 3, the case body 12 has top and bottom end portions 26 and 28 that are stepped radially inwardly. Each of the top and bottom end caps 14 and 16 has a cup-shaped configuration with an open mouth portion 30 sized to receive the case body's respective top or bottom end portion 26 and 28 in a male/female interconnection. Accordingly, the top end portion 26 of the case body 12 fits into open mouth portion 30 of the top end cap 14, and the bottom end portion 28 of the case body fits into the open mouth portion of the bottom end cap 16. The case body 12 of the illustrated embodiment engages the top and bottom end caps 14 and 16 in a friction fit that can allow for some axial movement of the case body relative to the end caps, although other configurations can be used in alternate embodiments.

The top and bottom end caps 14 and 16 each have an elastomeric sealing ring 32 attached to the open mouth portion 30 and that extends over the top and bottom end portions 26 and 28 of the case body 12. The sealing rings 32 have an outer diameter approximately the same size as the main portion of the case body 12 and the top and bottom end caps 14 and 16, such that the ammunition assembly 10 has a fairly uniform outer diameter along its length. The sealing rings 32, however, are adapted to expand radially outwardly and seal against the forward and aft ends of the breech when the ammunition assembly 10 is fired. The sealing rings 32 are made of an elastomer that can withstand the temperatures and pressures that occur in the firing chamber upon firing the ammunition assembly 10. After the ammunition assembly 10 has been fired, the sealing rings 32 contract and return substantially to their original pre-fired diameter, so the spent unit can be ejected from the breech of the firing device.

The ammunition assembly 10 includes a propellant bed 34 (shown only partially) contained in the case body 12. The bottom end cap 16 forms the closed bottom end of the ammunition assembly 10 so as to contain the propellant bed 34. The bottom end cap 16 is a noncombustible member than can withstand the high temperatures and pressures generated upon firing without being consumed. In the illustrated embodiment, the bottom end cap 16 is a steel alloy, although other materials can be used. The bottom end cap 16 removably retains an ignition device 36 (e.g., a primer) that extends into the propellant bed 34 to initiate burning and combustion of the propellant bed 34. The burning propellant bed 34 generates high pressure gas within the ammunition assembly 10 and the firing chamber of the firing device, thereby propelling the projectile into and through the barrel of the firing device. When the projectile 20 is fired, the outer end face 42 of the bottom end cap 16 seals against the breech face when the ammunition assembly 10 is in the firing chamber to help contain the high pressure gas in the firing chamber.

On the opposite end of the ammunition assembly 10, the top end cap 14 has an enlarged aperture 38 with substantially the same diameter as a leading portion 40 of the projectile 20 to allow for passage of the projectile through the top end cap upon firing. The outer end face 44 of the top end cap 14 is configured to sealably mate with the barrel face of the firing device when the ammunition assembly 10 is in the firing chamber and fired, thereby properly containing and directing the propellant gases through the top end cap into the barrel during the act of firing. The top end cap 14 is also a noncombustible member similar to the bottom end cap 16 that can withstand the temperatures and pressures generated upon firing without being consumed.

The top and bottom end caps 14 and 16 are securely interconnected to each other by the noncombustible internal support structure 18 positioned within the interior area 19 of the case body 12. The case body 12 extends around the support structure 18 but is not rigidly attached to the support structure. The case body 12 is also not rigidly attached to the top and bottom end caps 14 and 16. In the illustrated embodiment, the case body 12 is sized so it can move a slight distance axially relative to the top and bottom end caps 14 and 16 and the support structure 18 if an external axial load is exerted directly on the case body 12. Accordingly, the case body 12 essentially "floats" on the support structure 18 between the top and bottom end caps 14 and 16.

The top and bottom end caps 14 and 16 along with the support structure 18 define a load-bearing unit that provides a load path through the ammunition assembly 10. The load-bearing unit reacts external tensile, compression or bending loads that may be exerted on the ammunition assembly during handling and loading. The load-bearing unit is also configured to have ductile compressive and tensile properties suitable to withstand the pre-firing loads on the ammunition assembly 10, and also to withstand the forces generated within the firing chamber when the ammunition assembly is fired. The load-bearing unit is substantially independent of the case body 12, so the case body is substantially isolated from the load path and does not react the external loads. Accordingly, the case body 12 can be made of a combustible material that may not be strong enough to react the external loads without being damaged.

The support structure 18 also forms an internal frame-like structure that provides lateral support to the combustible case body 12 so as to help the case body react direct lateral impact loads that may occur during pre-firing handling of the ammunition assembly 10. The support structure 18 also helps maintain the ammunition assembly's overall cartridge cylindrical runout, also known in the industry as cylindricity, which is very important when trying to insert the ammunition assembly 10 into a firing chamber without binding interference.

In the illustrated embodiment, the support structure 18 includes a cylindrical guide sleeve 50 rigidly affixed to the top end cap 14. In one embodiment, the guide sleeve 50 has external threads that threadably mate with internal threads formed in the top end cap 14. The guide sleeve 50 is axially aligned with the top end cap 14 and has an inner diameter substantially identical to the aperture 38 in the top end cap. The guide sleeve 50 snugly yet removably retains the projectile 20 in the interior area 19 and in axial alignment with the case body 12 and the top end cap 14. The guide sleeve 50 is configured to assist in guiding the projectile 20 into the barrel of the firing device upon firing. In the illustrated embodiment, the guide sleeve 50 is made of a high-strength, noncombustible material, such as a steel alloy or the like, that is able to withstand the high temperatures and pressures created upon firing of the ammunition assembly 10.

The support structure 18 of the illustrated embodiment also has a plurality of elongated support rods 52 securely connected to the guide sleeve 50 and to the bottom end cap 16. The support structure 18 shown in FIG. 3 has four elongated support rods 52 equally spaced around the interior area 19 of the case body 12, although a different number of support rods or other support members could be used. The support rods 52 are substantially rigid and are made of a selected steel alloy, although other materials can be used in alternate embodiments. In the illustrated embodiment, the support rods 52 are shaped as tensile coupons (also known as "dog-bone" coupons) having an elongated middle portion 53 with an outer diameter smaller than the outer diameter at the ends of the support rods. The forward end 54 of each support rod 52 is fixedly retained in a blind hole 56 formed in the aft end 58 of the guide sleeve 50. The aft end 60 of each support rod 52 is securely connected to the bottom end cap 16. In alternate embodiments, the aft end 60 of each support rod can be attached to an intermediary mounting structure that fixedly attaches to the bottom end cap 16.

Figure 4:
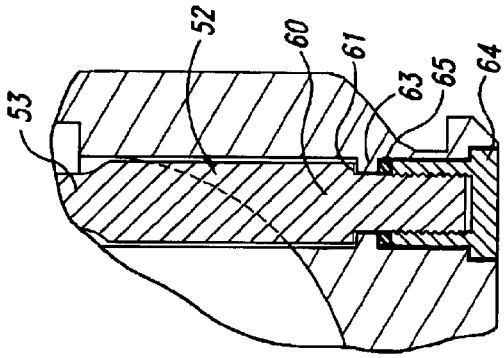
FIG. 4 is an enlarged detail view taken substantially at Detail 4 of FIG. 3.

FIG. 4 is an enlarged detail view of a portion of the bottom end cap 16 and an aft end 60 of a representative one of the support rods 52. The aft end 60 of each support rod 52 extends through an aperture 62 in the bottom end cap 16. The aft end 60 of each support rod 52 in the illustrated embodiment has an annular shoulder 61 that abuts an annular ridge 63 formed in the aperture 62. The annular ridge 63 blocks the support rod 52 from axial movement through the aperture 62 in the bottom end cap 16 in response to a compressive load. The aft end 60 of each support rod 52 also threadably attaches to a nut 64 or other suitable fastener securely connected to the bottom end cap 16. An O-ring 65 is positioned between the nut 64 and the annular ridge 63 to form a seal around the aft end 60 of the support rod 52. Accordingly, the aft end 60 of the support rod 52 is securely connected to the bottom end cap 16 so as to transmit tensile, compression, or bending loads between these two components of the load-bearing unit.

Figure 5:
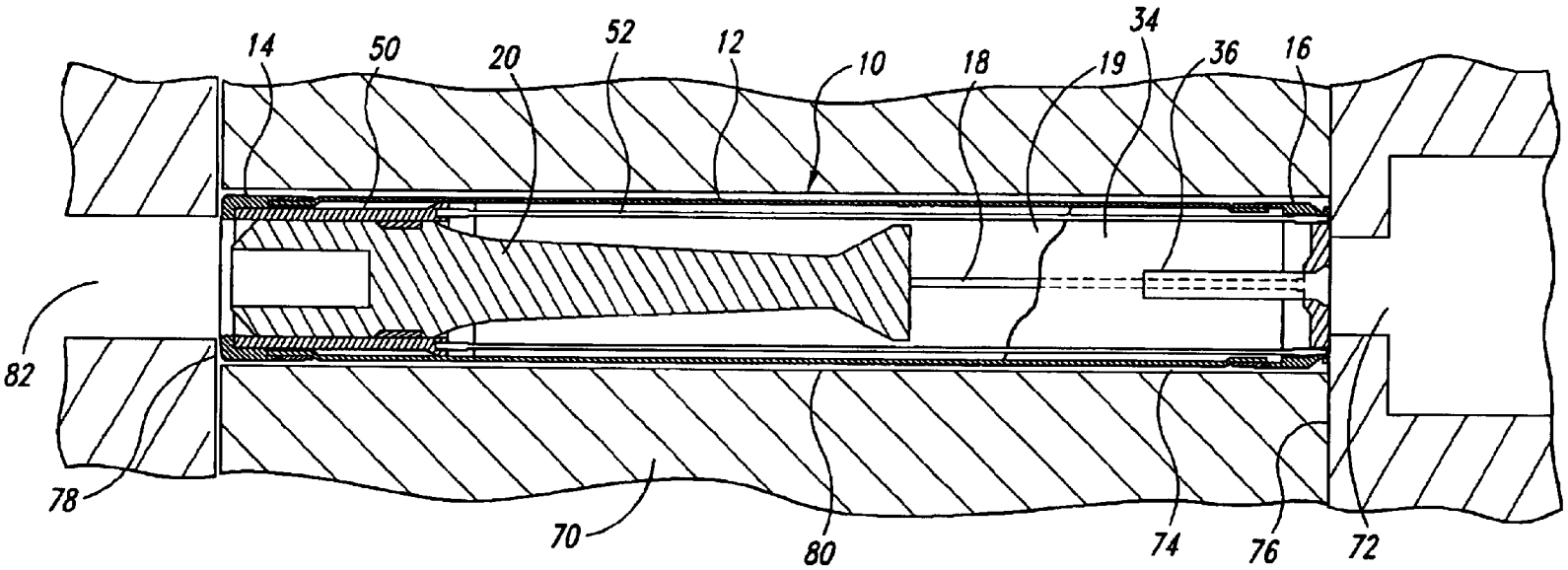
FIG. 5 is a cross-sectional view of the ammunition assembly of FIG. 1 positioned in a firing device.

FIG. 5 is a cross-sectional view of the ammunition assembly 10 shown positioned in a firing device 70. In use, the ammunition assembly 10 is inserted into the firing device's breech 72 and seated in the firing chamber 74 between the breech face 76 and barrel face 78. The ammunition assembly 10 is then in a position ready to fire. Upon firing, the ignition device 36 ignites the main propellant bed 34 and begins combustion of the propellant and generation of a pressure wave and a flame front in the case body 12. The gasses generated by the burning propellant bed 34 begin pressurizing the interior area 19 of the case body 12. The pressure wave and flame front, upon reaching the combustible case body 12, act to radially expand the combustible case body 12 and the elastomeric sealing rings 32 into contact with the firing chamber walls 80, thereby sealing the walls from the propellant gases.

The flame front from the burning propellant ignites the case body 12 and begins consuming the case body in combustion. As the propellant and case body 12 continue to burn, the pressure in the firing chamber 74 greatly increases, thereby creating tension stress on the support structure 18. This tension stress causes the support structure 18 to elastically deform axially within the firing chamber 74. The majority of this elastic deformation is substantially isolated to the middle portion 53 of the support rods 52 because of the reduced diameter of the middle portions. The top and bottom end caps 14 and 16 also move axially and engage the barrel face 78 and the breech face 76, respectively, thereby forming gas seals that prevent propellant gas leakage. The propellant bed 34 and the case body 12 are completely consumed within the firing chamber 74 and the pressures in the firing chamber drive the projectile 20 into the barrel 82 of the firing device 70. In one embodiment, the projectile 20 is adapted to engage rifling grooves (not shown) in the barrel 82 to impart spin to the projectile, and in other embodiments the projectile is adapted for firing through a smooth-bore barrel.

After the projectile 20 is fired out of the barrel 82 and the pressure in the firing chamber 74 and breech 72 is dissipated, the support structure 18 contracts axially substantially to its pre-fired condition, thereby pulling the top and bottom end caps 14 and 16 out of engagement with the barrel face 78 and the breech face 76, respectively. After firing, only the top and bottom end caps 14 and 16, the support structure 18, and ancillary items, such as the ignition device 36, remaining in the firing chamber 74 are retracted into the breech 72 as a unitary spent unit. The spent unit is then ejected from the firing device 70 in an ejection cycle. The support structure 18 holds the top and bottom end caps 14 and 16 in axial alignment during the ejection cycle, thereby greatly minimizing the risk of a jam in the firing chamber 74 or the breech 72, which would take the weapon out of service at least until the jam was cleared.

In one embodiment, the ammunition assembly 10 is usable in a gun or other firing device 70 having a firing chamber 74 configured to move out of alignment with the barrel face 78 and the breech face 76 in order to eject the unitary spent unit and load a fresh ammunition assembly 10. The fresh ammunition assembly 10 is loaded into the firing chamber 74 by pushing it in from the rear of the now open firing chamber. The fresh ammunition assembly 10 is firmly and aggressively pushed against the unitary spent unit, thereby ejecting it out of the front of the firing chamber 74. This reloading process typically creates a substantial axial impact and compressive load on the fresh ammunition assembly 10, and this axial impact is reacted along the load path so the combustible case body 12 is not damaged during the loading process. Upon completion of this loading/ejection cycle, the firing chamber 74 is realigned with the barrel face 78 and the breech face 76, and the chambered fresh ammunition assembly 10 is ready for firing.

From the foregoing, it will be appreciated that specific embodiments of the invention have been described herein for the purposes of illustration, but that various modifications may be made without deviating from the spirit and scope of the invention. Accordingly, the invention is not limited except as by the appended claims.

We claim:

1. A cased telescoped ammunition assembly configured to be fired, comprising:

a combustible case body defining an interior portion and made of a material substantially consumed in combustion when the ammunition assembly is fired;

first and second end caps connected to the combustible case body; and an internal support structure in the interior portion of the combustible case body and interconnecting the first and second end caps to define a load path substantially independent of the combustible case body and configured to react external loads in tension, compression and bending, the internal support structure being non-combustible during firing of the ammunition assembly.

2. The assembly of claim 1 wherein the internal support structure and the first and second end caps are ejectable as a spent unit from a firing device after the ammunition assembly is fired and the combustible case body is consumed in combustion.

3. The assembly of claim 1, further comprising a first seal connected to one of the first and second end caps and being radially expandable relative to the case body.

4. The assembly of claim 3, further comprising a second seal connected to the other of the first and second end caps and being radially expandable relative to the case body.

5. The assembly of claim 1, further comprising a projectile in the interior portion, and wherein the internal support structure includes a guide sleeve connected to the first end cap and releasably engaging a leading portion of the projectile.

6. The assembly of claim 1, further comprising a projectile in the interior portion, and wherein the internal support structure includes a guide sleeve concentrically disposed between the combustible case body and the projectile.

7. A cased telescoped ammunition assembly configured to be fired, comprising:

a combustible case body defining an interior portion and made of a material substantially consumed in combustion when the ammunition assembly is fired;

first and second end caps connected to the combustible case body; and an internal support structure in the interior portion of the combustible case body and interconnecting the first and second end caps to define a load path substantially independent of the combustible case body and configured to react external loads in tension, compression, and bending, the internal support structure includes a guide sleeve connected to the first end cap and a plurality of support rods extending between the guide sleeve and the second end cap.

8. The assembly of claim 1 wherein the combustible case body is constructed of a resinated molded fiber composite with an integral energetic component in the form of nitrocellulose fibers.

9. The assembly of claim 1 wherein the first and second end caps and the internal support structure define a load-bearing assembly that is elastically movable between a pre-fired condition and an axially expanded firing position, the load-bearing assembly configured to substantially return to the pre-fired condition after the ammunition assembly is fired.

10. A cased telescoped ammunition assembly configured to be fired, comprising:

a combustible case body defining an interior portion and made of a material substantially consumed in combustion when the ammunition assembly is fired;

first and second end caps connected to the combustible case body; and an internal support structure in the interior portion of the combustible case body and interconnecting the first and second end caps to define a load path substantially independent of the combustible case body and configured to react external loads in tension, compression, and bending, the internal support structure includes a plurality of elongated support rods attached directly to at least one of the first and second end caps.

11. A cased telescoped ammunition assembly configured to be fired, comprising:

a combustible case body defining an interior portion and made of a material substantially consumed in combustion when the ammunition assembly is fired;

first and second end caps connected to the combustible case body; and an internal support structure in the interior portion of the combustible case body and interconnecting the first and second end caps to define a load path substantially independent of the combustible case body and configured to react external loads in tension, compression, and bending, the internal support structure includes a plurality of tensile coupons.

12. A cased telescoped ammunition assembly comprising:

a combustible case body defining an interior portion and being configured to be consumed in combustion when the ammunition assembly is fired;

a propellant in the interior portion of the combustible case body;

first and second end caps connected to the combustible case body; and an internal support structure in the interior portion of the combustible case body and interconnecting the first and second end caps to define a load-bearing assembly forming a load path substantially independent of the combustible case body and the propellant, the load-bearing assembly being sized so the combustible case body can move axially relative thereto, the internal support structure being non-combustible during firing of the ammunition assembly.

13. The assembly of claim 12, wherein the load-bearing assembly defines a unitary structure ejectable from a firing device after the combustible case body is consumed in combustion.

14. The assembly of claim 12, further comprising a seal connected to one of the first and second end caps and being radially expandable relative to the combustible case body.

15. The assembly of claim 12, further comprising a projectile in the interior portion, and wherein the internal support structure includes a guide sleeve concentrically disposed between the projectile and the combustible case body.

16. The assembly of claim 12 wherein the combustible case body is constructed of a resinated molded fiber composite with an integral energetic component.

17. The assembly of claim 12 wherein the internal support structure includes a plurality of elongated support rods attached directly to at least one of the first and second end caps.

18. The assembly of claim 12 wherein the internal support structure includes a plurality of tensile coupons.

19. An ammunition firing system, comprising:

a firing device having a barrel; and a cased telescoped ammunition assembly sized to be loaded into the firing device and fired, the cased telescoped ammunition assembly comprising:

a projectile sized to be fired through the barrel;

a combustible case body containing the projectile and being configured to be consumed in combustion when the cased telescoped ammunition assembly is fired;

first and second end caps connected to opposing ends of the combustible case body; and an internal support structure in an interior portion of the combustible case body and interconnecting the first and second end caps to define a load-bearing assembly forming a load path substantially independent of the combustible case body, the load-bearing assembly configured to react external loads and to substantially isolate the case body from the external loads, the internal support structure being non-combustible during firing of the ammunition assembly, the internal support structure and the first and second end caps define an ejectable spent unit after the combustible case body is consumed.

20. The system of claim 19, further comprising a first seal connected to one of the first and second end caps and being radially expandable into sealable engagement with the firing device when the cased telescoped ammunition assembly is fired.

21. The system of claim 19, further comprising a second seal connected to the other of the first and second end caps and being radially expandable into sealable engagement with the firing device when the cased telescoped ammunition round is fired.

22. The system of claim 19 wherein the internal support structure includes a guide sleeve connected to the first end cap and concentrically disposed between the projectile and the combustible case body.

23. An ammunition firing system, comprising:

a firing device having a barrel; and a cased telescoped ammunition assembly sized to be loaded into the firing device and fired, the cased telescoped ammunition assembly comprising:

a projectile sized to be fired through the barrel;

a combustible case body containing the projectile and being configured to be consumed in combustion when the cased telescoped ammunition assembly is fired;

first and second end caps connected to opposing ends of the combustible case body; and an internal support structure in an interior portion of the combustible case body and interconnecting the first and second end caps to define a load-bearing assembly forming a load path substantially independent of the combustible case body, the load-bearing assembly configured to react external loads and to substantially isolate the case body from the external loads, the internal support structure and the first and second end caps define an ejectable spent unit after the combustible case body is consumed, the internal support structure includes a guide sleeve connected to the first end cap and a plurality of elongated support rods extending between the guide sleeve and the second end cap.

24. The system of claim 19 wherein the combustible case body is constructed of a resinated molded fiber composite with an integral energetic component.

25. The system of claim 19 wherein the load-bearing member is elastically deformable during the firing of the cased telescoped ammunition assembly.

26. A cased telescoped ammunition assembly, comprising:

a first end member;

an ignition device connected to the first end member;

a combustible case body coupled to the first end member;

a propellant contained in the combustible case body adjacent to the ignition device;

a second end member coupled to the combustible case body assembly opposite the first end member;

an internal support structure interconnecting the first and second end members, the internal support structure being non-combustible during firing of the ammunition assembly, and the combustible case body being axially movable relative to the first and second end members and the support structure; and a projectile contained in the combustible case body.

27. A cased telescoped ammunition assembly configured to be fired in a firing device and being subjectable to external operational loads in tension and compression, comprising:

a combustible case body having first and second end portions and defining an interior portion, the combustible case body being configured to be substantially consumed when the ammunition assembly is fired;

a first end cap attached to the first end portion of the combustible case body;

a second end cap attached to the second end portion of the combustible case body;

a plurality of structural elements within the interior portion of the combustible case body and interconnecting the first and second end caps to form a noncombustible load-bearing structure that defines a load path configured to react the external operational loads independent of the combustible case body, the noncombustible load-bearing structure configured to be ejected from the firing device as a unit after the combustible case body is consumed;

an ignition device connected to the second end cap and extending into interior area;

a propellant contained in the interior area;

a projectile contained in the case body and configured to be fired through the first end cap; and a seal connected to one of the first and second end caps and configured to expand radially to sealably engage the firing device when the ammunition round is fired and while the combustible case body is consumed.

28. A method of firing a cased telescoped ammunition assembly, comprising:

loading an ammunition assembly into a breech of a firing device, the ammunition assembly including:

a combustible case body;

a projectile contained in the case body;

a propellant contained in the case body;

first and second end caps connected to the case body; and an internal support structure interconnecting the first and second end caps to define a load-bearing assembly in the case body that forms a load path substantially independent of the case body;

reacting a compression load by the load-bearing assembly along the load path while substantially isolating the case body from the compression load on the case body;

igniting the propellant to create combustion in the ammunition assembly;

consuming the propellant and the case body substantially fully in combustion;

propelling the projectile into the barrel with the load-bearing assembly remaining in the breech as a spent unit after the propellant and the case body are consumed; and ejecting the spent unit from the breech after the projectile has been propelled into the barrel.

29. The method of claim 28 wherein the ammunition assembly is a first ammunition assembly, and ejecting the spent unit includes opening the breech, inserting a second ammunition assembly into the breech while the spent unit is in the breech, and forcing the spent unit out of the breech with the second ammunition assembly.

30. The method of claim 29 wherein ejecting the spent unit includes exerting a compression load on the second ammunition assembly when the second ammunition assembly forces the spent unit out of the breech.

31. The method of claim 28, further comprising forming a seal between the ammunition assembly and the breach when the propellant is ignited.

32. A cased telescoped ammunition assembly configured to be fired, comprising:

a combustible case body defining an interior portion and made of a material substantially consumed in combustion when the ammunition assembly is fired;

first and second end caps connected to the combustible case body; and an internal support structure in the interior portion of the combustible case body and interconnecting the first and second end caps to define a load path substantially independent of the combustible case body and configured to react external loads in tension, compression, and bending, the internal support structure being non-combustible during firing of the ammunition assembly.

33. A cased telescoped ammunition assembly configured to be fired, comprising:

a combustible case body defining an interior portion and made of a material substantially consumed in combustion when the ammunition assembly is fired;

first and second end caps coupled to the combustible case body and being non-combustible during firing of the ammunition assembly; and an internal support structure in the interior portion of the combustible case body and interconnecting the first and second end caps to define a load path substantially independent of the combustible case body and configured to react external loads in tension, compression, and bending.

34. A cased telescoped ammunition assembly configured to be fired, comprising:

a combustible case body defining an interior portion and made of a material substantially consumed in combustion when the ammunition assembly is fired;

first and second end caps adjacent to opposing ends of the combustible case body and being non-combustible during firing of the ammunition assembly;

a propellant contained in the combustible case body; and an internal support structure in the interior portion of the combustible case body and interconnecting the first and second end caps to define a load path substantially independent of the combustible case body and configured to react external loads in tension, compression, and bending.

35. A cased telescoped ammunition assembly configured to be fired, comprising:

a combustible case body made of a material consumed when the ammunition assembly is fired;

first and second end caps adjacent to opposing ends of the combustible case body;

a propellant contained in the combustible case body; and an internal support structure in the combustible case body and connected to the first and second end caps to define a load path within the combustible case that reacts external loads in tension, compression, and bending, the internal support structure being non-combustible during firing of the ammunition assembly.

* * * * *